US008910811B2

(12) United States Patent
Parrinello et al.

(10) Patent No.: US 8,910,811 B2
(45) Date of Patent: Dec. 16, 2014

(54) CLOSURE FOR A SEALED CONTAINER OF A POURABLE FOOD PRODUCT, AND METHOD OF PRODUCING THEREOF

(75) Inventors: Fiorenzo Parrinello, Medicina (IT); Fabrizio Pucci, Castel Guelfo di Bologna (IT); Rune Berg, Dalby (SE); Mats Qvarford, Lund (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 1073 days.

(21) Appl. No.: 12/663,176

(22) PCT Filed: Jun. 4, 2008

(86) PCT No.: PCT/EP2008/056945
§ 371 (c)(1),
(2), (4) Date: Jan. 5, 2010

(87) PCT Pub. No.: WO2008/148823
PCT Pub. Date: Dec. 11, 2008

(65) Prior Publication Data

US 2010/0140208 A1 Jun. 10, 2010

(30) Foreign Application Priority Data

Jun. 5, 2007 (EP) ..... 07109674

(51) Int. Cl.

| | |
|---|---|
| ***B65D 41/34*** | (2006.01) |
| ***B65D 51/22*** | (2006.01) |
| ***B65D 8/00*** | (2006.01) |
| *B65D 53/04* | (2006.01) |

(52) U.S. Cl.
CPC ..... *B65D 51/228* (2013.01); *B65D 2251/0015* (2013.01); *B65D 2251/0071* (2013.01); *B65D 11/04* (2013.01)
USPC ..... 215/252; 215/350

(58) Field of Classification Search
USPC ..... 215/349, 252, 253, 318, 350
See application file for complete search history.

(56) References Cited

U.S. PATENT DOCUMENTS 5,184,746 A 2/1993 Moore et al.
5,564,603 A 10/1996 Malmberg
(Continued)

FOREIGN PATENT DOCUMENTS

EP 0 648 679 A1 4/1995
EP 0 931 729 A2 7/1999
(Continued)

OTHER PUBLICATIONS

Office Action issued on Mar. 15, 2013 by Japan Patent Office in corresponding Japanese Patent Application No. 2010-510793, and English translation thereof.

(Continued)

*Primary Examiner* — Mickey Yu
*Assistant Examiner* — Niki Eloshway
(74) *Attorney, Agent, or Firm* — Buchanan Ingersoll & Rooney PC

(57) ABSTRACT

There is described a closure for a sealed container of a pourable food product, comprising a pouring spout defining a pour opening externally closed by a cover portion, a cap fitted to the pouring spout in a removable way, an opening member interposed between the cap and the cover portion of the pouring spout and joined to the cover portion, and a driving mechanism carried by the cap to engage and pull the opening member along a direction transversal thereto upon removal of the cap from the pouring spout so as to detach the cover portion from the neck portion and free the pour opening when the closure is first unsealed by the user.

48 Claims, 4 Drawing Sheets

(56) References Cited

U.S. PATENT DOCUMENTS

| | | | | |
|---|---|---|---|---|
| 5,947,315 | A | 9/1999 | Valyi et al. | |
| 6,142,334 | A | 11/2000 | Kristensson | |
| 7,168,581 | B2 * | 1/2007 | Robinson et al. | 215/349 |
| 7,648,764 | B2 * | 1/2010 | Yousif | 428/346 |
| 7,766,178 | B2 * | 8/2010 | Robinson et al. | 215/349 |
| 2002/0027122 | A1 | 3/2002 | Herrera | |
| 2004/0011459 | A1 | 1/2004 | Henegar | |
| 2005/0001355 | A1 | 1/2005 | Gustafsson et al. | |
| 2005/0098529 | A1 * | 5/2005 | Bloom et al. | 215/276 |
| 2006/0278642 | A1 * | 12/2006 | Pugne et al. | 220/256.1 |
| 2006/0283831 | A1 * | 12/2006 | Krueger | 215/349 |
| 2008/0083694 | A1 | 4/2008 | Ammann | |
| 2010/0140271 | A1 | 6/2010 | Benedetti et al. | |

FOREIGN PATENT DOCUMENTS

| | | | |
|---|---|---|---|
| EP | 0 965 531 | A1 | 12/1999 |
| EP | 1 147 990 | A2 | 10/2001 |
| EP | 1 197 438 | B1 | 3/2004 |
| JP | 56-109948 | U | 1/1955 |
| JP | 47-37896 | Y | 11/1972 |
| JP | 4-132937 | U | 12/1992 |
| JP | 10-101012 | A | 4/1998 |
| JP | 2002-527311 | A | 8/2002 |
| JP | 2004-330453 | A | 11/2004 |
| JP | 2007-204092 | A | 8/2007 |
| JP | 2008-137702 | A | 6/2008 |
| WO | WO 03/061940 | A1 | 7/2003 |
| WO | WO 2005/044538 | A1 | 5/2005 |
| WO | WO 2006/002922 | A1 | 1/2006 |

OTHER PUBLICATIONS

International Search Report issued by the International Searching Authority (European Patent Office) on Jul. 30, 2008 in International Application No. PCT/EP2008/056945.

Written Opinion issued by the International Searching Authority (European Patent Office) on Jul. 30, 2008 in International Application No. PCT/EP2008/056945.

International Preliminary Report on Patentability completed by the International Preliminary Examining Authority (European Patent Office) on Jul. 23, 2009 in International Application No. PCT/EP2008/056945.

Japanese Office Action issued Apr. 19, 2013 by the Japanese Patent Office in Japanese Patent Application No. 2011-510954 and English language translation of the Japanese Office Action (5 pgs).

* cited by examiner

CLOSURE FOR A SEALED CONTAINER OF A POURABLE FOOD PRODUCT, AND METHOD OF PRODUCING THEREOF

TECHNICAL FIELD

The present invention relates to a closure for a sealed container of a pourable food product, and to a method of producing thereof.

BACKGROUND ART

As it is known, many pourable food products, such as fruit juice, milk, tomato sauce, and beverages in general, are sold in a wide range of containers of different types and sizes, such as: parallelepiped-shaped packages made of multilayer, plastic- and/or paper-based, laminated materials or so-called multilayer cardboard materials; beaker-shaped plastic packages; blow-molded bottles; or glass, sheet metal or aluminium containers.

All these containers are fitted with closures which can be opened to allow access by the consumer to the food product, either to pour it into a drinking vessel or consume it straight from the container.

Screw cap closures are commonly used on bottle-type containers, whereas containers made of multilayer cardboard materials are often simply provided with tear-off markers, or with pour openings formed in the containers and covered with pull tabs.

Containers made of multilayer cardboard materials are also known to be fitted with plastic closures injection molded directly onto the containers, about openings formed through the packaging material, so as to completely close and seal the openings. Closures of this sort normally define the pour opening of the container, which may be fitted, for example, with a screw or snap cap.

Injection molded closures may of course be of various sizes and even define the whole top of the container, as in the case of the container known by the registered trademark "Tetra Top", and the top of which is illustrated in Patent Application EP-A-0965531.

Though permitting precise, high-quality forming, injection molding container tops does not allow for integrating a layer of gas-barrier material in the tops, as required, for example, when packaging vitamin-supplemented fruit juice.

As described, for example, in Patent EP-B-1197438 and Patent Application WO 03/061940, plastic tops of containers are also known to be produced by blowing a plastic tubular preform, which may include a layer of gas- and also light-barrier material.

The container known by the trademark "Tetra Aptiva" is one example of a container produced using this technique, i.e. having a main bottom portion made of multilayer cardboard material, and a top, for pouring the liquid or pourable product in the container, produced by blowing a plastic tubular preform.

This technique provides for a high degree of forming precision, especially as regards the pour opening, but has the drawback of requiring the use of special-purpose equipment.

To produce plastic tops or closures to be applied to the container portion of multilayer cardboard material, a method has recently been devised comprising thermoforming and injection molding operations, but no blowing.

One example of this method is described in Patent Application WO 2005/044538, and comprises the step of thermoforming a sheet body of multilayer plastic material having a layer of gas-barrier material, e.g. EVOH. The body is defined integrally by an annular base portion, which is eventually fitted to the cardboard bottom portion of the container, and by a cylindrical neck portion projecting from the inner edge of the base portion and defining, with the base portion, a pour opening by which to pour out the food product. Since thermoforming is performed starting from a sheet of plastic material, the neck portion is closed at its side opposite to the base portion. A protective outer layer of plastic material, with a lateral thread to screw on a cap, is injection molded onto the sheet body so as to form a pouring spout for the container.

After the above operations, and before applying the cap, the material closing the pour opening is removed.

In order to achieve a gas-tight closure of the resulting pouring spout after filling the container, an aluminum foil is welded to the top edge of the spout. After this operation, the cap is finally screwed on the pouring spout.

The above method of producing plastic tops or closures for combined cardboard-plastic containers mainly has the drawback of involving a good deal of time, work, and waste in costly material.

In fact, the portion of material closing the pour opening after the thermoforming operation, and which is removed before applying the cap, normally amounts to about 15-20% of the starting material and, in addition, has a considerable cost as, differently from commonly used plastic materials such as polyethylene or polypropylene, it contains a gas-barrier layer.

Moreover, the aluminum foil welded to the top edge of the pouring spout to achieve a gas-tight closure constitutes a costly additional member, which must be produced and fitted to the spout before the cap is applied to the container.

Furthermore, the resulting closure requires an annoying two-steps operation by the user to obtain the first unsealing. In fact, it is necessary first to unscrew the cap from the pouring spout and then to tear off the aluminum foil covering the spout to reach the content.

DISCLOSURE OF INVENTION

It is an object of the present invention to provide a closure for a sealed container of a pourable food product, which is designed to eliminate the aforementioned drawbacks in a straightforward and low-cost manner.

It is another object of the present invention to provide a closure for a sealed container of a pourable food product, which is capable of ensuring an effective gas- and/or light-barrier and allows to reduce the waste in costly material during its producing process as well as to obtain the first unsealing in a reliable and easy way through a single-step operation and with reduced effort by the user.

At least one of these objects is achieved by a closure for a sealed container of a pourable food product, as claimed in claim 1.

The present invention also relates to a method of producing a closure for a sealed container of a pourable food product, as claimed in claim 23.

BRIEF DESCRIPTION OF THE DRAWINGS

A number of preferred, non-limiting embodiments of the present invention will be described by way of example with reference to the accompanying drawings, in which.

BEST MODE FOR CARRYING OUT THE INVENTION

Figure 2:
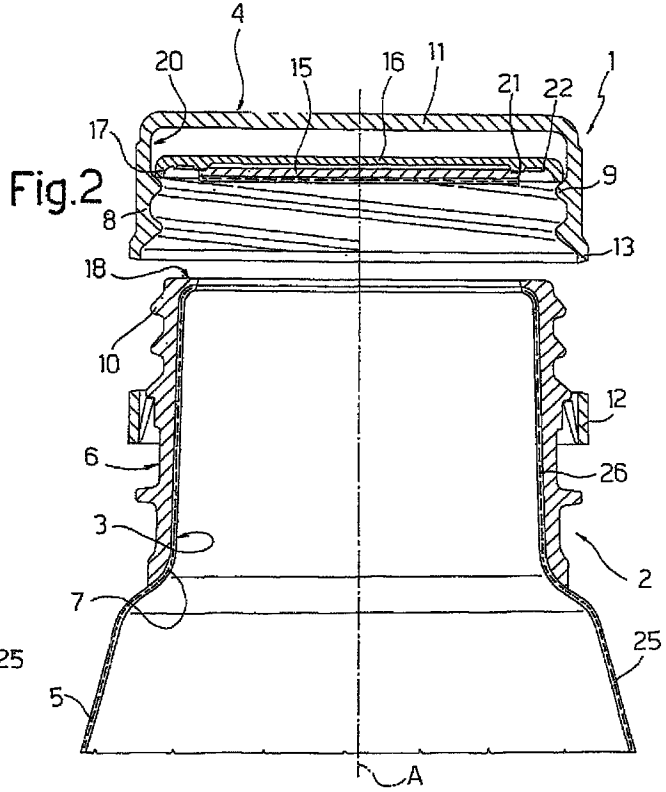
FIG. 2 shows a vertical section of the FIG. 1 closure after opening.

Number 1 in FIGS. 1-4 indicates as a whole a closure for a container (not shown) of liquid or pourable food products, such as a plastic closure for a combined cardboard-plastic container—to which the following description refers purely by way of example.

Closure 1 has a longitudinal axis A and basically comprises a pouring spout 2, having at least a layer of gas- and/or light-barrier material, e.g. EVOH, and defining a pour opening 3, by which to pour the food product out of the container, and a cylindrical cap 4 fitted to pouring spout 2 in a removable way.

More specifically, pouring spout 2 comprises an annular base portion 5, which, in the example shown, is concave inwards of the container, and a substantially cylindrical tubular neck portion 6, which projects from an inner radial edge 7 of base portion 5, and defines, with base portion 5, pour opening 3.

According to a possible alternative not shown, base portion of pouring spout 2 may be also configured to define integrally a complete top or end wall of the container.

Cap 4 is produced in a single piece and is substantially defined by a cylindrical lateral wall 8, which has an internal thread 9, with one or more starts, for engaging a corresponding thread 10 provided on an outer lateral surface of neck portion 6, and by a disk-shaped top wall 11 for covering, in use, the top of pouring spout 2.

In an alternative embodiment not shown, lateral wall 8 of cap 4 may be internally provided with a plurality of cam projections suitable for engaging corresponding projections on neck portion 6.

In practice, in both cases, cap 4 is fittable to and removable from pouring spout 2 along a stroke having a translational component parallel to axis A and a rotational component about such axis.

Cap 4 is molded integrally, in the usual way, with a respective tamperproof ring 12 connected coaxially to a bottom edge 13 of lateral wall 8 by breakable connecting means 14, such as one annular breakable bridge or a number of radial breakable bridges.

Cap 4 is fitted initially to pouring spout 2 in a completely closed or sealed position (FIG. 1), wherein the cap is screwed completely onto neck portion 6, with bottom edge 13 and tamperproof ring 12 still connected to each other and resting on opposite sides of a bottom portion of thread 10 of neck portion 6 or an annular rib extending on the neck portion at a lower position than thread 10 with respect to axis A.

Once unsealed, cap 4 is movable between an open position (FIG. 2), in which it is unscrewed off pouring spout 2, and a closed-again position, in which it is completely screwed on the pouring spout so as to reseal pour opening 3.

As described in greater detail below, pouring spout 2 is produced, and attached to the container, in a closed configuration, in which a disk-shaped cover portion 15, integral with neck portion 6, closes pour opening 3 on the side of neck portion 6 opposite to the side facing, in use, the container; when cap 4 is first removed by pouring spout 2, i.e. when the container is first unsealed by the user, cover portion 15 is detached from neck portion 6 as a result of the movement of cap 4 so freeing pour opening 3.

Advantageously, such action of cap 4 on cover portion 15 is performed through a disk-shaped opening member 16, which is joined, for instance by welding, to cover portion 15 and is engaged and pulled along axis A by an upper portion of thread 9 or other suitable driving means of cap 4 during removal thereof from pouring spout 2.

In particular, opening member 16 is interposed between top wall 11 of cap 4 and cover portion 15 when joined to the latter, and is free from any rotational connection with cap 4.

Opening member 16 has an outer edge 17 protruding radially with respect to the top surface of pouring spout 2 so as to be engaged by the upper portion of thread 9, i.e. the portion of thread 9 adjacent to such outer edge, when cap 4 is unscrewed from neck portion 6; outer edge 17 is rounded and is bent towards neck portion 6 so as to extend over a top edge 18 thereof.

Figure 3:
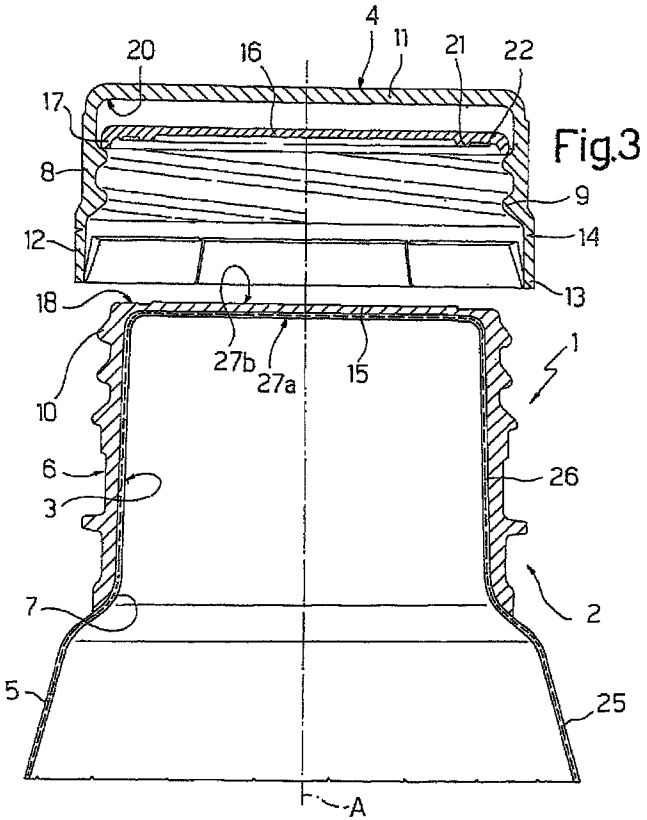

As clearly visible in particular in FIGS. 2 and 3, top wall 11 of cap 4, the upper portion of thread 9 and the part of lateral wall 8 of the cap limited therebetween define a retaining seat 20 for opening member 16 to prevent the latter from unintentionally coming off the cap.

The particular shape of outer edge 17 of opening member 16 eases engagement with driving means and insertion in retaining seat 20 of cap 4.

In particular, opening member 16 is retained inside seat 20 of cap 4 with a given play in the radial and axial directions so as to freely rotate about axis A and to move substantially along such axis between top wall 11 and the upper portion of thread 9 of the cap.

Figure 1:
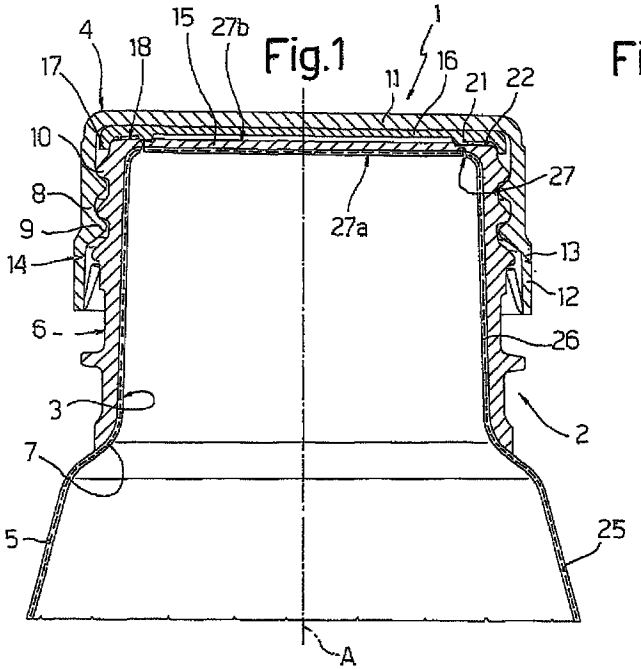
FIG. 1 shows a vertical section of a closure, in accordance with the present invention, for a sealed container of a pourable food product.
Figure 4:
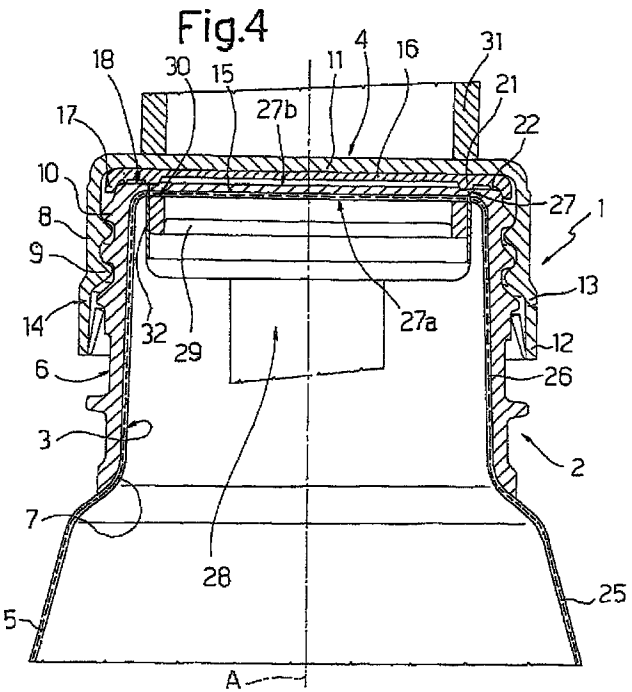
FIGS. 3 and 4 show vertical sections of the FIG. 1 closure at various stages in a method according to the present invention.

As shown in FIGS. 1, 2 and 4, opening member 16 has a first annular ridge 21, along which it is welded to cover portion 15 of pouring spout 2, and a second annular ridge 22, which extends between annular ridge 21 and outer edge 17 and defines a contact portion cooperating with top edge 18 of neck portion 6 in the completely closed and closed-again positions of cap 4 so as to ensure resealing of closure 1 even after the first unsealing of the container.

Closure 1 is produced according to the method described below.

Firstly, a forming operation, preferably a thermoforming or hot forming operation, is performed on a multilayer plastic sheet material comprising a layer of gas- and/or light-barrier material, e.g. EVOH.

The forming operation produces a hollow, substantially hat-shaped body 25, which is open on the side facing the container to which it is eventually attached, and is closed on the opposite side.

More specifically, body 25 comprises an annular bottom portion integrally defining base portion 5, and an inverted cylindrical cup-shaped top portion 26 projecting axially from the inner radial edge of the bottom portion. Top portion 26 has a lateral wall defining the inner side of neck portion 6, and therefore laterally bounding pour opening 3, and a disk-shaped top wall closing pour opening 3.

Alternatively, body 25 may be produced by other suitable forming techniques, such as compression or injection molding.

Body 25 may be also produced from a plastic material having no gas- and/or light-barrier property, and a layer of gas- and/or light-barrier material may be provided by a surface coating.

Next, plastic material, such as polyethylene or polypropylene, is overmoulded by compression onto the outer side of top portion 26 of body 25 to form thread 10 and other neck features so as to impart sufficient thickness and rigidity to those parts.

All these operations permit to obtain pouring spout 2 in the configuration shown in FIG. 3.

When forming of pouring spout 2 is obtained by compression or injection molding, the overmoulding step is not necessary; in fact, compression or injection molding allow forming, in a single step, body 25 and all neck features, such as thread 10.

As a result of the described operations, neck portion 6 and cover portion 15 define integral parts of pouring spout 2, in the sense that they derive from forming operations only, without any necessity of joining them through welding or gluing.

At the same time, cap 4 and opening member 16 are formed singularly through known techniques and then assembled together. In particular, opening member 16 is pressed into retaining seat 20 of cap 4 and is hold in place by thread 9.

At this point, the assembly defined by cap 4 and opening member 16 is applied to pouring spout 2 (FIG. 4), so that threads 9 and 10 engage mutually, and top wall 11 of cap 4 presses opening member 16 against the top surface of pouring spout 2 at the annular ridges 21 and 22.

After this further assembly operation, opening member 16 is welded, e.g. heat sealed, onto cover portion 15 of pouring spout 2 at ridge 21.

In order to ease detachment of cover portion 15 from neck portion 6 during first unsealing of closure 1, a weakening circumferential line 27 is also produced along the periphery of the cover portion.

Preferably (FIG. 4), weakening line 27 is obtained as a score, i.e. a partial cut, produced on a side 27*a* of cover portion 15 facing pour opening 3 or, in an equivalent manner, facing away from top wall 11 of cap 4. The scoring operation can be performed, for instance, by a hot or cold blade or by ultrasonic or laser devices.

In the example shown in FIG. 4, the welding operation and the formation of weakening line 27 are performed simultaneously by a ultrasonic device 28; it substantially comprises a substantially cylindrical tubular pressure member 29, having an annular work surface 30 cooperating with top wall of body 25 and an ultrasound generating unit (not shown), a backing member 31 cooperating with top wall 11 of cap 4 on the opposite side to pressure member 29, and guide means (not shown) for moving pressure member 29 to and from backing member 31 to obtain the desired compression force during ultrasound generation.

The outer periphery of pressure member 29 may be fitted with a cutting member 32 which acts on cover portion 15 to make weakening line 27.

It is pointed out that pouring spout 2, cap 4 and opening member 16 could be made of different materials.

Figure 5:
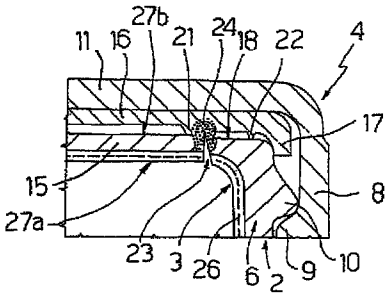
FIG. 5 shows a larger-scale vertical section of a detail of the FIG. 1 closure at a given stage in a possible variant of the method according to the present invention.

According to a possible alternative shown in FIG. 5, performing the weakening operation in a hot state, e.g. by using ultrasonic or laser devices, hot tools, etc., and all through the periphery of cover portion 15, it is possible to obtain not only a complete cut 23 of the material under opening member 16, but also a weld 24 of the top surface of cover portion 15 to the opening member around the cutting zone. In practice, due to the melting effect on the material around the cutting zone, the weakening operation produces a simultaneous joining of the overlap parts in such zone.

At the end of the above-described operations, cover portion 15 defines a layer of gas- and/or light-barrier material of cap 4, i.e. a "liner", as this layer is commonly referred to in the packaging of pourable food products.

Figure 6:
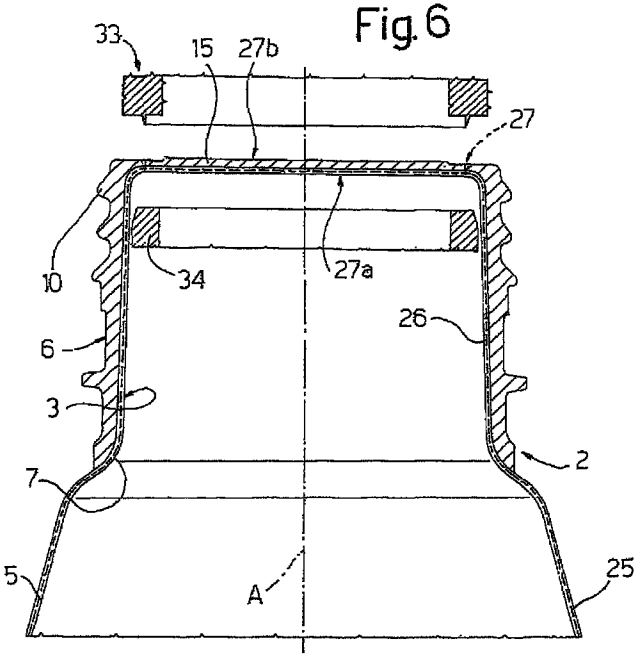
FIG. 6 shows a vertical section of the FIG. 1 closure at a given stage in another possible variant of the method according to the present invention.

According to another possible alternative shown in FIG. 6, weakening line 27 can be obtained as a score produced on a side 27*b* of cover portion 15 facing in use top wall 11 of cap 4.

In this case, the weakening operation may be performed directly in the overmoulding process of thread 10 and the other neck features, e.g. by using an annular ridge 33 or a blade to be pushed into the still soft material in the mold on side 27*b* of cover portion 15, and a backing member 34 acting on opposite side 27*b* of the cover portion to produce the desired contrasting force. As a consequence, only the welding operation has to be performed after assembly of pouring spout 2 with cap 4 and opening member 16.

Alternatively, the weakening operation may be also performed after the overmoulding operation in a separate station.

In any case, the weakening operation on pouring spout 2 need to be performed before the pouring spout is assembled with opening member 16 and cap 4.

According to a further possible alternative not shown, the weakening operation may be also performed by producing respective score lines on both sides 27*a*, 27*b* of cover portion 15.

According to a still further possible alternative not shown, opening member 16 may be applied and welded onto cover portion 15 of pouring spout 2 and, then, cap 4 may be fitted to the assembly defined by pouring spout 2 and the opening member.

This alternative applies whatever side of cover portion 15 the weakening operation is performed onto.

First unsealing of the container is obtained in a single step by unscrewing cap 4 off pouring spout 2.

As cap 4 is turned about axis A anticlockwise in FIG. 1, mating threads 9 and 10 simultaneously move cap 4 axially away from pouring spout 2 so as to break connecting means 14; as a result of this action, tamperproof ring 12 is retained resting axially against the bottom portion of thread 10 of neck portion 6.

At this stage, opening member 16, being free from any rotational connection with cap 4, is kept still against the top surface of cover portion 15 it is welded to.

Upon further rotation of cap 4 with a consequent translation along axis A, the upper portion of thread 9 engages outer edge 17 of opening member 16 and, upon even further rotation of the cap, a vertical force is produced onto opening member 16 to pull it up along axis A; as of this point, opening member 16 moves together with cap 4 along axis A, so producing a breaking action at the weakening line 27 to detach cover portion 15 from neck portion 6 of pouring spout 2 and to free pour opening 3. In practice, opening member 16 is driven by cap 4 in a completely translational motion along axis A, while the cap has a roto-translational motion.

When cap 4 is completely removed from pouring spout 2, opening member 16 and cover portion 15 are retained within seat 20 by thread 9 in a floating condition so as not to come off the cap unintentionally.

By virtue of the weld, cover portion 15 remains joined to opening member 16 as opposed to being discarded.

The container can be closed again by simply fitting cap 4 back onto pouring spout 2. In this condition, the resealing of closure 1 is ensured by cooperation of ridge 22 with top edge 18 of neck portion 6 under the pressure exerted by cap 4 on pouring spout 2 in the closed-again position.

Figure 7:
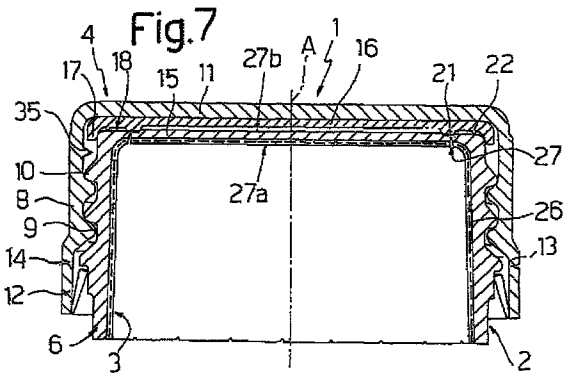
FIGS. 7 to 11 show respective vertical sections of possible variants of the FIG. 1 closure.

The variant of FIG. 7 relates to a different configuration of the driving means of cap 4 for engaging and pulling opening member 16 along axis A.

In this case, the driving means comprises an annular protrusion 35 extending from the inner surface of lateral wall 8 and, in the example shown, located at a higher level than upper portion of thread 9 along axis A. Protrusion 35 may also consist of different elements angularly spaced about axis A and located at the same or different levels with respect to such axis.

The driving means may also be defined by a protrusion of the type shown in FIG. 7 but not extending along the entire circumference about axis A and by an upper portion of thread 9 both cooperating with outer edge 17 of opening member 16 to pull it up along axis A during the roto-translational motion of cap 4.

Figure 8:
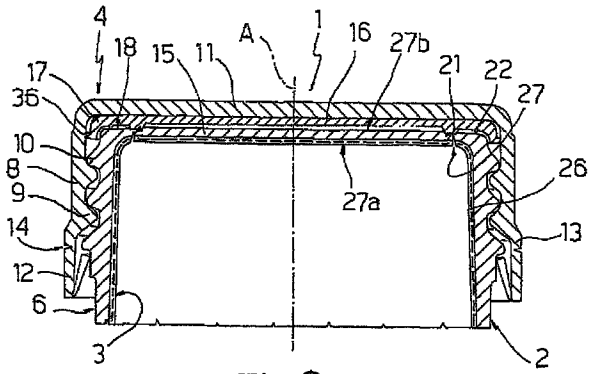
Figure 9:
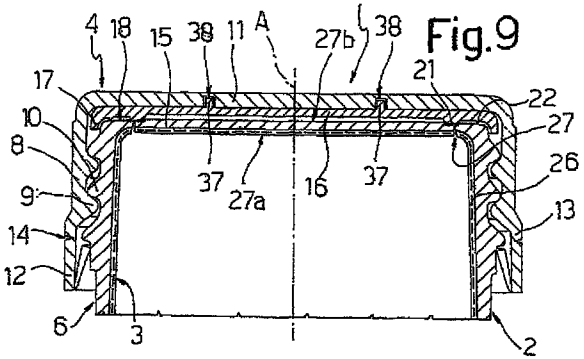

The variants of FIGS. 8 and 9 relate to different solutions to ensure, after first removal of cap 4 from pouring spout 2, correct centering of opening member 16 inside seat 20 of the cap, and therefore with respect to the pouring spout, when the container is closed again. By maintaining centering, correct resealing of closure 1 is guaranteed.

In the embodiment of FIG. 8, opening member 16 has, along its outer circumference, a thin protruding extension 36 cooperating with inner surface of lateral wall 8 of cap 4 to help keeping the opening member centered inside seat 20 without impairing assembly of such member with cap 4.

In the embodiment of FIG. 9, opening member 16 and top wall 11 of cap 4 respectively have protrusions 37 and complementary recesses 38 mutually engaging to define a centered position of the opening member with respect to the cap in the completely closed and closed-again positions thereof. Each protrusion 37 and the complementary recess 38 may also have tapered configurations towards the inner of top wall 11 to ease their mutual engagement during the final stage of the screwing movement of the cap onto pouring spout 2.

It is evident that protrusions 37 may be also provided on top wall 11 of cap 4 and complementary recesses 38 on opening member 16.

Figure 10:
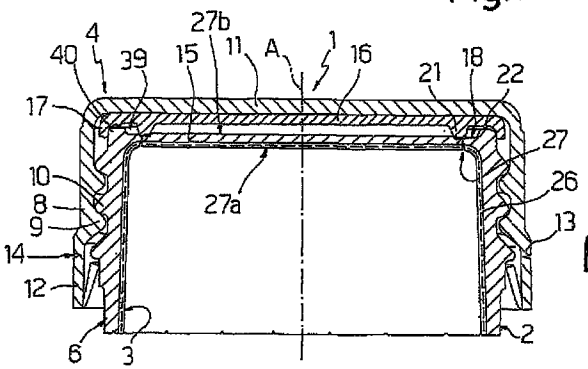

The variant of FIG. 10 relates to a different solution of pouring spout 2, whose top edge 18 has a rounded annular ridge 40 capable of producing a positive sensation to the user's mouth during direct consumption of the product from the container.

In this case, due to the presence of rounded ridge 40, the configuration of opening member 16 is modified; in particular, ridge 21 of opening member 16 has a greater height when compared to the above-described solutions so as to be welded to cover portion 15, and delimits, with outer edge 17, an annular seat 39 having a U-shaped section for receiving, with a given play, rounded edge 40 of pouring spout 2.

Resealing is obtained through cooperation of ridge 22 of opening member 16 and rounded ridge 40 of pouring spout 2.

According to a further possible variant not shown, resealing of closure 1 may be also obtained by configuring seat 39 exactly with a shape complementary to that one of rounded edge 40 of pouring spout 2; in this case, ridge 22 may be not necessary. Besides, this arrangement could also help to ensure a correct centering of opening member 16 with respect to pouring spout 2.

Figure 11:
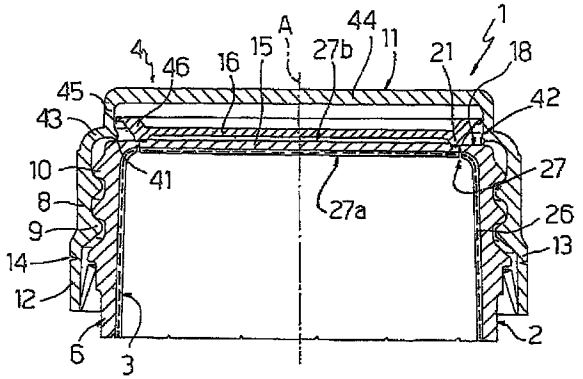

In the variant of FIG. 11, the resealing of closure 1 after the first unsealing is ensured by a protruding lip 41 of cap 4 which also defines a driving means to engage and pull opening member 16 along axis A during the first removal of cap 4 from pouring spout 2.

In particular, in this case, opening member 16 only performs the function of receiving a vertical force from cap 4 during the first unsealing of closure 1 and transmitting that force to cover portion 15 to detach the latter from the rest of pouring spout 2.

More specifically, in order to perform both the functions of resealing closure 1 and driving opening member 16 in its pull-up movement, top wall 11 of cap 4 has an inverted cylindrical cup-shaped configuration with an open end edge 42 externally connected to lateral wall 8 through a circular band 43 and internally provided with protruding lip 41.

In greater detail, top wall 11 of cap 4 integrally comprises a disk-shaped main portion 44, having a diameter greater than the one of pour opening 3 and extending at a higher level than circular band 43 with respect to axis A, and a lateral cylindrical portion 45 connecting main portion 44 with circular band 43 and defining, at intersection with the latter, end edge 42.

Protruding lip 41 extends from end edge 42 respectively towards the top surface of pouring spout 2 and towards axis A so as to stick out radially of lateral cylindrical portion 45.

When cap 4 is completely screwed onto pouring spout 2, protruding lip 41 is pressed against top edge 17 of neck portion 6 so ensuring resealing of closure 1.

Opening member 16 has, in this case, a truncated cone-shaped outer edge 46 projecting towards lateral cylindrical portion 45 and main portion 44 so as to be engaged and pulled along axis A by protruding lip 41 during first unsealing of closure 1.

Engagement between protruding lip 41 and outer edge 46 also ensures a correct centering of opening member 16 with respect to cap 4.

The advantages of closure 1 and the method of producing thereof will be clear from the foregoing description.

Thanks to the fact that sealing of the pouring side of pouring spout 2 is defined by cover portion 15, which is simply obtained through the forming operation for producing the spout, any waste in material is eliminated, particularly when this material has a gas- and/or light-barrier material and is therefore quite costly. In fact, in this case, cover portion 15 is simply welded to opening member 16 in order to be then detached from the spout during the first unsealing of the container, instead of being first removed at the end of the forming process of the pouring spout and then replaced by an additional member welded to the spout and which needs to be removed again at the first use.

Moreover, thanks to the use of opening member 16, welded to cover portion 15 of pouring spout 2, the first unsealing of closure 1 can be achieved by the user through a single-step operation and with low effort.

In fact, during rotation of cap 4, opening member 16 is driven by the cap in a pure translational movement along axis A, thereby producing simultaneous detachment of cover portion 15 from neck portion 6 through a tensile stress.

The applicant has noted that this kind of stress on the cover portion of the pouring spout permits to achieve the first unsealing of the container with a reduced effort from the user when compared to a shear stress on the full outline of the material to be removed. In a completely equivalent manner, in order to allow the user to first unseal the container through an acceptable opening torque, the use of a tensile stress has a reduced impact on the demand for weakening the breaking zone when compared to a shear stress.

In fact, the applicant has estimated that, in the latter case, a sufficient weakening of the breaking zone requires that the material remaining in the cut (i.e. connecting the two parts to be subsequently detached) be as thin as a few hundredths of a millimeter, with an accuracy of a few thousandths of a millimeter. This can be very difficult to realize in practice.

In the case of the present invention, the applicant has estimated that the demand for weakening the breaking zone is reduced about one order of magnitude.

Moreover, by arranging the driving means (e.g. the upper portion of thread 9 and/or one or multiple protrusions 35) on the cap 4 at different levels along axis A so as to start engagement with outer edge 17 of opening member 16 at one specific point, and to progressively increase the engaging area as the cap is turned, may further reduce the demand for weakening. In fact, in this case, the torque effort required to the user is smaller than that one in the case of driving means all located at the same level along axis A.

Furthermore, thanks to the fact that opening member 16 is free from any rotational connection with cap 4, the angle of cap rotation before initiating the breaking of cover portion 15 can be adjusted, for instance to have this angle of rotation greater than the one required to break the connecting means 14 linking tamperproof ring 12 to the cap. This can be made by opportunely setting the value of play in the direction of axis A between opening member 16 and the receiving seat 20 of cap 4.

Clearly, changes may be made to closure 1 and to the method as described and illustrated herein without, however, departing from the scope as defined in the accompanying claims.

The invention claimed is:

1. A closure for a sealed container of a pourable food product, said closure comprising:

a pouring spout having a neck portion to define a pour opening and a cover portion closing the pour opening on the side of said neck portion opposite to the side facing, in use, the container, the cover portion being integrally molded in one piece with the neck portion; and a cap fittable to, and removable from, the pouring spout;

an opening member interposed between the cap and the cover portion of the pouring spout and joined to said cover portion; and driving means separate from the opening member and carried by the cap to directly engage and pull the opening member along an axis transversal thereto upon removal of said cap from the pouring spout so that the opening member detaches the cover portion from the neck portion and frees the pour opening when the closure is first unsealed by the user.

2. A closure as claimed in claim 1, wherein the pouring spout has at least a layer of gas- and/or light-barrier material.

3. A closure as claimed in claim 2, wherein the neck portion and the cap have respective engaging threads to define said stroke.

4. A closure as claimed in claim 3, wherein the driving means comprises a portion of the thread of the cap adjacent to the opening member.

5. A closure as claimed in claim 1, wherein the cap is removable from the pouring spout along a stroke having at least a component parallel to said axis.

6. A closure as claimed in claim 5, wherein the stroke of the cap with respect to the pouring spout has a rotational component about said axis, and wherein the cap is freely rotatable about said axis with respect to the opening member.

7. A closure as claimed in claim 1, wherein the cover portion of the pouring spout has a weakening along its outer periphery to ease detachment of said cover portion from the neck portion during first unsealing of the closure.

8. A closure as claimed in claim 7, wherein the weakening comprises a score produced on a side of the cover portion facing away from the cap.

9. A closure as claimed in claim 7, wherein the weakening comprises a score produced on a side of the cover portion facing the cap.

10. A closure as claimed in claim 7, wherein the weakening comprises scores produced on both sides of the cover portion.

11. A closure as claimed in claim 7, wherein the weakening comprises a cut all through the cover portion, a welding area between the cover portion and the opening member extending around the cut.

12. A closure as claimed in claim 1, wherein a top part of the cap and the driving means define a retaining seat for the opening member to prevent said opening member from unintentionally coming off the cap.

13. A closure as claimed in claim 12, wherein the opening member is retained in a freely rotatable manner within the retaining seat of the cap.

14. A closure as claimed in claim 12, wherein the opening member is contained inside the retaining seat of the cap with a given play along said axis.

15. A closure as claimed in claim 12, wherein it further comprises centering means for maintaining the opening member centered inside the retaining seat of the cap.

16. A closure as claimed in claim 15, wherein said centering means comprises mutually engaging protrusion and recess means provided on the cap and the opening member.

17. A closure as claimed in claim 1, wherein the driving means comprises at least one element extending from a lateral wall of the cap towards the neck portion of the pouring spout.

18. A closure as claimed in claim 17, wherein the driving means comprises a number of said elements located at different levels along said axis.

19. A closure as claimed in claim 1, wherein the opening member has a contact portion for cooperating with a region of the pouring spout around the pour opening to ensure resealing of the closure even after the first unsealing thereof.

20. A closure as claimed in claim 1, wherein the cap has a contact portion for cooperating with a region of the pouring spout around the pour opening to ensure resealing of the closure even after the first unsealing thereof.

21. A closure as claimed in claim 20, wherein the contact portion of the cap is a protruding lip also acting as driving means to engage and pull the opening member during the first removal of said cap from the pouring spout.

22. A closure as claimed in claim 1, wherein the closure is configured so as to define integrally a complete end wall of the container.

23. A closure as claimed in claim 1, wherein the cover portion and the neck portion are formed in one piece.

24. The closure of claim 1, wherein the opening member possesses a larger diameter than the cover portion so that an outer peripheral portion of the opening member is positioned farther from a central axis of the pouring spout than an outer peripheral portion of the cover portion.

25. A method of producing a closure as claimed in claim 1, said method comprising:

forming the pouring spout in a closed configuration in which a cover portion closes the pour opening;

forming the cap to be fitted to the pouring spout in a removable way;

forming the opening member; and joining the opening member to the cover portion of the pouring spout so that it is interposed in use between the cap and said cover portion.

26. A method as claimed in claim 25, wherein said step of forming the pouring spout comprises:

forming a body open on the side facing in use the container and closed on the opposite side; and overmoulding plastic material onto the side of said body opposite to that bounding the pour opening to finish the pouring spout.

27. A method as claimed in claim 26, wherein said step of overmoulding comprises forming a thread on the body for engaging a thread of the cap.

28. A method as claimed in claim 26, wherein said forming of said body is performed from a plastic material having a gas- and/or light-barrier layer.

29. A method as claimed in claim 26, wherein a layer of gas- and/or light-barrier material is provided by a surface coating of said body.

30. A method as claimed in claim 25, further comprising producing a weakening along the periphery of the cover portion to ease detachment of said cover portion from the neck portion during first unsealing of the closure.

31. A method as claimed in claim 30, wherein the weakening is produced at least as a scoring of the cover portion.

32. A method as claimed in claim 30, wherein said producing of the weakening is performed on the side of said cover portion facing away from the cap the pour opening.

33. A method as claimed in claim 30, wherein said steps of joining and producing a weakening are performed after application of the opening member onto the pouring spout.

34. A method as claimed in claim 33, wherein said joining and producing the weakening are performed simultaneously.

35. A method as claimed in claim 34, wherein said producing of the weakening is performed in a hot state and all through the periphery of the cover portion so as to produce a complete cut of the material under the opening member and a weld of said cover portion to said opening member around the cutting zone.

36. A method as claimed in claim 30, wherein said producing of the weakening is performed on the side of the cover portion facing in use the cap.

37. A method as claimed in claim 36, wherein said producing of the weakening is performed during said overmoulding.

38. A method as claimed in claim 36, wherein said producing of the weakening is performed after said overmoulding.

39. A method as claimed in claim 36, wherein said producing of the weakening is performed before said joining of the opening member to the cover portion.

40. A method as claimed in claim 30, wherein said producing of the weakening is performed on both sides of the cover portion.

41. A method as claimed in claim 25, wherein said joining is performed after said cap and said opening member are assembled and applied to the pouring spout.

42. A method as claimed in claim 25, wherein said joining is performed before the cap is assembled with the opening member and applied onto the pouring spout.

43. A method as claimed in claim 25, wherein said joining is welding.

44. A closure for a sealed container of a pourable food product, the closure comprising:

a pouring spout including: (i) a neck portion extending in an axial direction and surrounding a pour opening, and (ii) a cover portion removably attached to the neck portion and covering the pour opening;

a cap removably attached to and fitted over the pouring spout, the cap possessing an interior surface including a circumferential surface and an axial end surface;

an opening member fixed to the cover portion and positioned along the axial direction between the axial end surface of the cap and the cover portion, the opening member being separate from the cap so that the cap is free to rotate independently of the opening member; and a protrusion extending from the circumferential surface of the cap, the protrusion being configured to move together with the cap in such a way that, during a first removal of the cap from the pouring spout, the protrusion moves along the axial direction and first contacts the opening member to engage and pull the opening member along the axial direction upon removal of the cap from the pouring spout to detach the cover portion from the neck portion so that the pouring opening is opened when the closure is first unsealed by a user.

45. The closure of claim 44, wherein the cover portion and the neck portion are formed in one piece.

46. The closure of claim 44, wherein the opening member possesses a larger diameter than the cover portion so that an outer peripheral portion of the opening member is positioned farther from a central axis of the pouring spout than an outer peripheral portion of the cover portion.

47. A closure for a sealed container of a pourable food product, said closure comprising:

a pouring spout having a neck portion to define a pour opening and a cover portion closing the pour opening on the side of the neck portion opposite to the side facing, in use, the container, the cover portion being integrally molded in one piece with the neck portion;

a cap fittable to, and removable from, the pouring spout;

an opening member interposed between the cap and the cover portion of the pouring spout and joined to the cover portion; and driving means, separate from the opening member and carried by the cap, for directly contacting and pulling the opening member along an axis transversal thereto upon removal of the cap from the pouring spout, and without directly contacting the cover portion, so that movement of the opening member detaches the cover portion from the neck portion and frees the pour opening when the closure is first unsealed by the user.

48. A closure for a sealed container of a pourable food product, the closure comprising:

a pouring spout having a neck portion to define a pour opening and a cover portion closing the pour opening on the side of the neck portion opposite to the side facing, in use, the container;

a cap fittable to, and removable from, the pouring spout;

an opening member interposed between the cap and the cover portion of the pouring spout and joined to the cover portion;

the cover portion and the neck portion being formed in one piece at the same time so that the cover portion and the neck portion are integrally formed with one another without being separately joined together; and driving means, separate from the opening member and carried by the cap, for engaging and pulling the opening member along an axis transversal thereto upon removal of the cap from the pouring spout so that the opening member detaches the cover portion from the neck portion and frees the pour opening when the closure is first unsealed by the user.

* * * * *